US007367533B2

(12) United States Patent
Yamaguchi et al.

(10) Patent No.: US 7,367,533 B2
(45) Date of Patent: May 6, 2008

(54) POINT SWITCHING DEVICE

(75) Inventors: Takashi Yamaguchi, Tokyo (JP); Jingo Wada, Tokyo (JP)

(73) Assignee: Konami Corporation, Tokyo (JP)

( * ) Notice: Subject to any disclaimer, the term of this patent is extended or adjusted under 35 U.S.C. 154(b) by 202 days.

(21) Appl. No.: 10/542,866

(22) PCT Filed: Jan. 16, 2004

(86) PCT No.: PCT/JP2004/000288

§ 371 (c)(1),
(2), (4) Date: Oct. 13, 2005

(87) PCT Pub. No.: WO2004/064963

PCT Pub. Date: Aug. 5, 2004

(65) Prior Publication Data

US 2006/0113430 A1 Jun. 1, 2006

(30) Foreign Application Priority Data

Jan. 17, 2003 (JP) ..... 2003-010462

(51) Int. Cl.
*B61L 5/00* (2006.01)

(52) U.S. Cl. ..... 246/415 A; 246/231; 246/227

(58) Field of Classification Search ..... 246/415 A, 246/220, 231, 232, 233, 234, 235, 227, 415 R; 238/10 E, 10 R; 446/446
See application file for complete search history.

(56) References Cited

U.S. PATENT DOCUMENTS

| | | | | |
|---|---|---|---|---|
| 1,548,940 | A * | 8/1925 | Gill | 246/231 |
| 4,223,857 | A * | 9/1980 | Hussein | 246/231 |
| 5,085,148 | A | 2/1992 | Konno | |
| 6,039,291 | A | 3/2000 | Dobson, IV | |

FOREIGN PATENT DOCUMENTS

| | | |
|---|---|---|
| JP | 3328479 B2 | 9/1992 |
| JP | 9084962 | 3/1997 |

OTHER PUBLICATIONS

International Search Report for PCT/JP2004/000288 mailed Feb. 24, 2004.

* cited by examiner

*Primary Examiner*—Mark Le
(74) *Attorney, Agent, or Firm*—Darby & Darby P.C.

(57) ABSTRACT

A point switching device that is disposed at a diverging point on tracks on which a movable body travels is provided. This point switching device includes: a point that rotates around a support point on one end, and can move between a first position and a second position; a first coil that generates an induction field to drive the point to the first position; a second coil that generates an induction field to drive the point to the second position; and an excitation control unit that selectively supplies an intermittent exciting current to the first coil or the second coil.

5 Claims, 10 Drawing Sheets

POINT SWITCHING DEVICE

CROSS-REFERENCE TO PRIOR APPLICATION

This is a U.S. national phase application under 35 U.S.C. §371 of International Patent Application No. PCT/JP2004/000288 filed Jan. 16, 2004, and claims the benefit of Japanese Patent Application No. 2003-010462 filed Jan. 17, 2003 which is incorporated by reference herein. The International Application published in Japanese on Aug. 5, 2004 as WO 2004/064963 A1 under PCT Article 21(2).

TECHNICAL FIELD

The present invention relates to a point switching device that is electrically controlled.

Background ART

In connection with toys that are moved on rails, such as train models that run on rails, point switching devices that are electrically controlled through the operations by users are already widely known as the means of switching points at the diverging point on rails.

However, when one of diverging tracks is made travelable by a point, a conventional point switching device needs to switch the point so as to allow a movable body that is coming in the opposite direction from the other diverging track to pass through thedivergingpoint. If the switchingoperation is notperformed, the running of the movable body is blocked by the point, and the movement of the movable body might be interrupted, or the movable body might be derailed.

DISCLOSURE OF INVENTION

Therefore, the object of the present invention is to provide a point switching device that does not require a point switching operation to allow a movable body coming from the opposite direction on a non-selected track of diverging tracks to pass through the diverging point.

The above described problems are eliminated by a point switching device that is provided at a diverging point on tracks on which a movable body travels. This point switching device includes: a point that can move between a first position and a second position by rotating around a support point on one end thereof; a first coil that generates an induction field to drive the point to the first position; a second coil that generates an induction field to drive the point to the second position; and an excitation control unit that selectively supplies an intermittent exciting current to the first coil or the second coil.

According to the present invention, when an exciting current is applied to the first coil, for example, the first coil generates an induction field to move the point to the first position. The exciting current is not constantly supplied to the first coil, but is intermittently supplied to the first coil. Accordingly, an induction field is only intermittently generated. When the induction field is generated, the point is guided toward the first position. However, when the induction field is not generated, the position of the point is not maintained in the first position. Even if the traveling of the movable body is blocked by the point, the point is pushed by the movable body still heading forward, and is moved to the second position. While the point is located in the second position, the movable body can pass through the diverging point. After the movable body passes through the diverging point, the point moved to the second position is driven back to the first position when an induction field is generated again. Thus, the point switching operation for the movable body coming from the direction blocked by the point is unnecessary.

Furthermore, the intermittent electricity supply can save electricity consumption.

The point switching device may further include an electricity supply unit that has a battery as the source of electricity to be supplied to the first coil and the second coil. Thus, the point switching device has a different power source from that of the tracks, and can be used even if the tracks do not require a power source.

The point switching device may further include a point position display unit that displays on the tracks whether the point is located in the first position or the second position. Thus, the travel able direction of the movable body at the diverging point is clearly indicated, so that the running direction of the movable body can be recognized at a glance. Thus, the entire operation to allow the movable body to travel can be simplified.

BEST MODE FOR CARRYING OUT THE INVENTION

Figure 1:
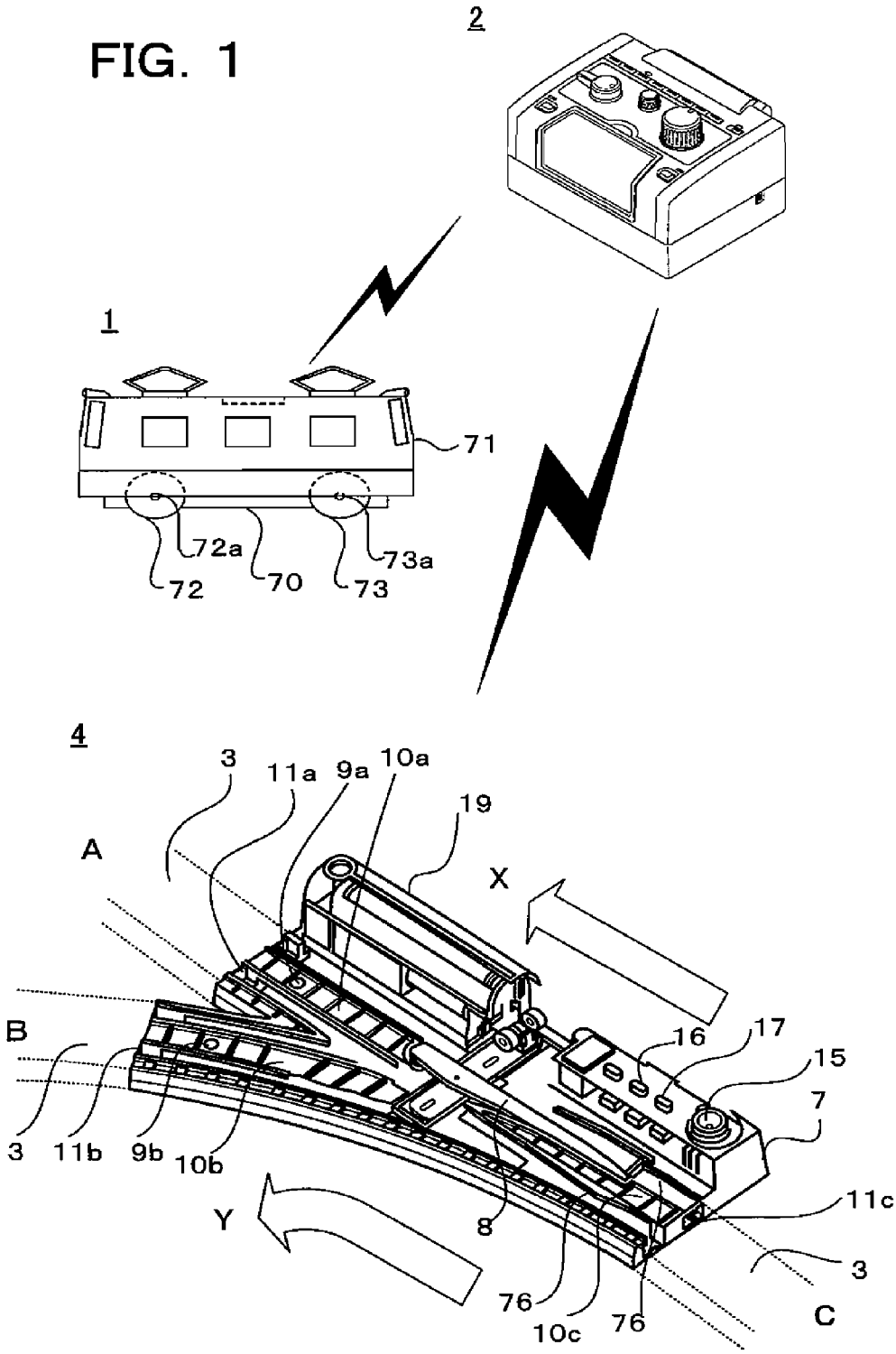
FIG. 1 shows an example of embodiment of the present invention.

FIG. 1 shows an example of embodiment of the present invention. A train model 1 is remotely controlled with drive information contained in a control signal transmitted from a controller 2. The train model 1 runs on rails 3 as tracks, and a point switching device 4 is provided at a diverging point on the rails 3. The point switching operation of the point switching device 4 is also remotely controlled with the drive information contained in the control signal transmitted from the controller 2. The controller 2 is capable of controlling the running of each of train models 1 . . . 1, and also is capable of controlling the point switching operation of each of point switching devices 4 . . . 4. The means of remote control may be of a cable type or a wireless type. In this embodiment, infrared rays are used as the means of remote control, and the train models 1 . . . 1 are identified with ID codes that are unique to each train model 1. The point switching devices 4 . . . 4 are identified with point numbers that are unique to each switching device 4.

The train model 1 includes a chassis 70 and a compartment body 71 that covers the upper portion of the chassis 70 as a unit to move the train. A pair of side-to-side front wheels 72 and a pair of side-to-side rear wheels 73 are rotatably attached to the chassis 70 via an axle 72*a* and an axle 73*a*, respectively. The front wheels 72 or the rear wheels 73 are rotated by a drive motor provided in the train model 1, so that the train model 1 can travel.

The point switching device 4 includes diverging rails 6, a control box 7, and a battery placement unit 19. The diverging rails 6 diverge so that the train model 1 coming from the direction C can travel in the direction A or the direction B. Hereinafter, the path that extends from the direction C to the direction A will be referred to as the path X, and the path that extends from the direction C to the direction B will be referred to as the path Y. The diverging rails 6 include a point 8, LED lamp display units 9*a* and 9*b* each of which serves as a point location display unit for each of the directions A and B, and track pieces 10*a*, 10*b*, and 10*c* that guide the train model 1 toward the directions A, B, and C, respectively. Further, rail connecting units 11*a*, 11*b*, and 11*c* for connecting the rails 3 to each of the directions A, B, and C are provided at the ends of the diverging rails 6. Hereinafter, the LED display units 9*a* and 9*b*, and the track pieces 10*a*, 10*b*, and 10*c* will be referred to simply as the LED display unit 9 and the track piece 10, unless a specific distinction is necessary.

The track piece 10 is located in the middle of a running unit 76, and have is elevated to be belt-like shaped. The train model 1 travels on the track piece 10 so that the side-to-side wheels 72 and 73 sandwich the track piece 10. As the inner side surfaces of the front wheels 72 and the rear wheels 73 of the train model 1 travels in contact with the outer side surfaces of the track pieces 10, the train model 1 travels in a direction guided by the track piece 10. For instance, the train model 1 traveling from the direction C to the direction A runs from the track piece 10*c* to the track piece 10*a* via the point 8. The train model 1 traveling from the direction C to the direction B runs from the track piece 10*c* to the track piece 10*c* via the point 8. Each of the track pieces 10 continues to a track piece (not shown) provided on the rails to which the diverging rails 6 are connected.

A remote-control signal light receiver 15 that receives the control signal from the controller 2, an initial setting switch 16 for setting the initial position of the point 8, and a point number setting switch 17 for setting the point number of the point switching device 4 are provided on the surface of the control box 7. The battery placement unit 19 houses a battery (batteries) to serve as an electricity supply unit for the point switching device 4.

Each of the LED lamp display units 9 has an LED lamp, and turns on the LED lamp corresponding to the travelable path in conjunction with the movement of point 8. For example, FIG. 1 shows a situation in which the path X is a travelable path. In this situation, the LED lamp of the LED lamp display unit 9*a* is turned on, and the LED lamp of the LED lamp display unit 9*b* is turned off. Although the LED lamp display units 9 may be in any color and may take any shape, it is preferable that each of the LED lamp display units 9 is in a high-visibility color and has a high-visibility shape.

Figure 2A:
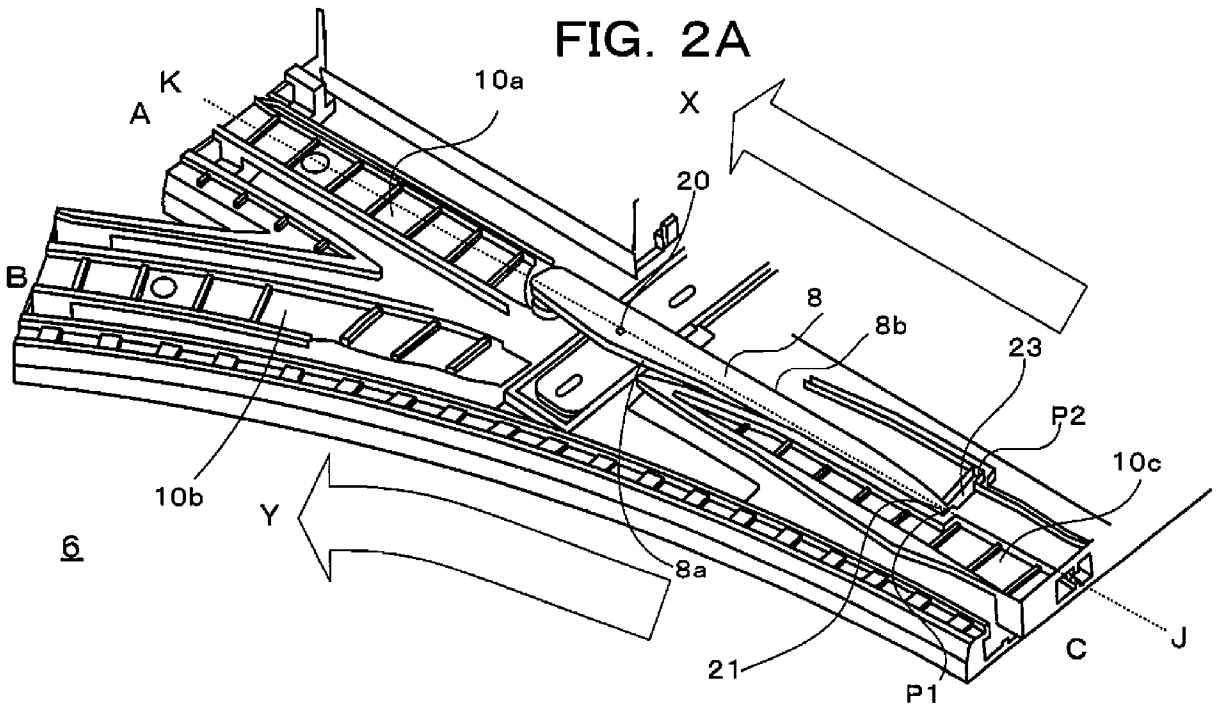
FIG. 2A is an enlarged view of the diverging rails.
Figure 2B:
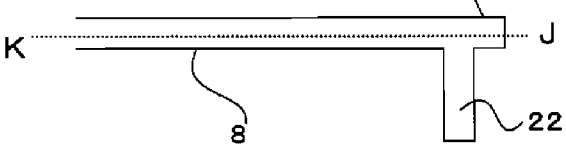
FIG. 2B is a cross-sectional view of the point, taken along the line J-K of FIG. 2A.

Referring now to FIGS. 2A and 2B, the configuration of the point 8 is described. FIG. 2A is an enlarged view of the upper side of the diverging rails 6. FIG. 2B is a cross-sectional view of the point 8 of the diverging rails 6, taken along the line J-K of FIG. 2A.

The point 8 is long and thin shaped, and one end of the point 8 is attached to the diverging rails 6 via a shaft 20. A movable portion 21 that is the other end of the point 8 can move between a first position P1 and a second position P2, with the shaft 20 serving as the point of support. The point 8 further has a protrusion 22 provided at the lower side of the movable portion 21, as shown in FIG. 2B. The protrusion 22 protrudes through the bottom side of the diverging rails 6. Therefore, a groove 23 is formed between the positions P1 and P2, so that the protrusion 22 can move between the positions P1 and P2 but cannot move beyond the positions P1 and P2.

The relationship between the positions of the point 8 and the paths is now described. When the movable portion 21 is located at the first position P1, the point 8 becomes parallel to the path X, and functions as a track piece that connects the track piece 10*c* to the track piece 10*a*. Accordingly, when the movable portion 21 is located at the first position P1, the train model 1 coming from the direction C travels along the path X. Meanwhile, the second position P2 is located on the right side of the traveling direction of the train model 1 coming from the direction C. Therefore, when the movable portion 21 is at the second position P2, the right-side front wheel 72 (in the traveling direction) of the train model 1 coming from the direction C runs into a rim of the point 8 after the train model 1 travels past the track piece 10*c*. The rim into which the right-side front wheel 72 runs is referred to as the P1-side rim 8*a*, and the rim on the other side is referred to as the P2-side rim 8*b*. Since the point 8 does not move beyond the second position P2, the train model 1 travels along the P1-side rim 8*a*, and is then guided from the track piece 10*c* to the track piece 10*b*. Accordingly, when the movable portion 21 is located at the second position P2, the train model 1 travels along the path Y.

When the movable portion 21 is at the first position P1, the left-side front wheel 72 (in the traveling direction) of the train model 1 traveling in the reverse direction of the path Y runs into the P1-side rim 8*a* of the point 8. Therefore, the train model 1 cannot travel further ahead, unless the movable portion 21 switches to the second position P2. When the movable portion 21 is at the second position P2, the left-side front wheel 72 (in the traveling direction) of the train model 1 traveling in the reverse direction of the path X runs into the P2-side rim 8*b* of the point 8. Therefore, the train model 1 cannot travel further ahead, unless the movable portion 21 switches to the first position P1.

Hereinafter, the situation in which the movable portion 21 is at the first position P1 will be sometimes referred to as "the situation in which the point 8 is at the first position P1" or "the situation in which the protrusion 22 is at the first position P1". The same applied to the second position P2. Also, the situation in which the movable portion 21 moves between the first position P1 and the second position P2 might be referred to as "the point 8 is switched".

Figure 3:
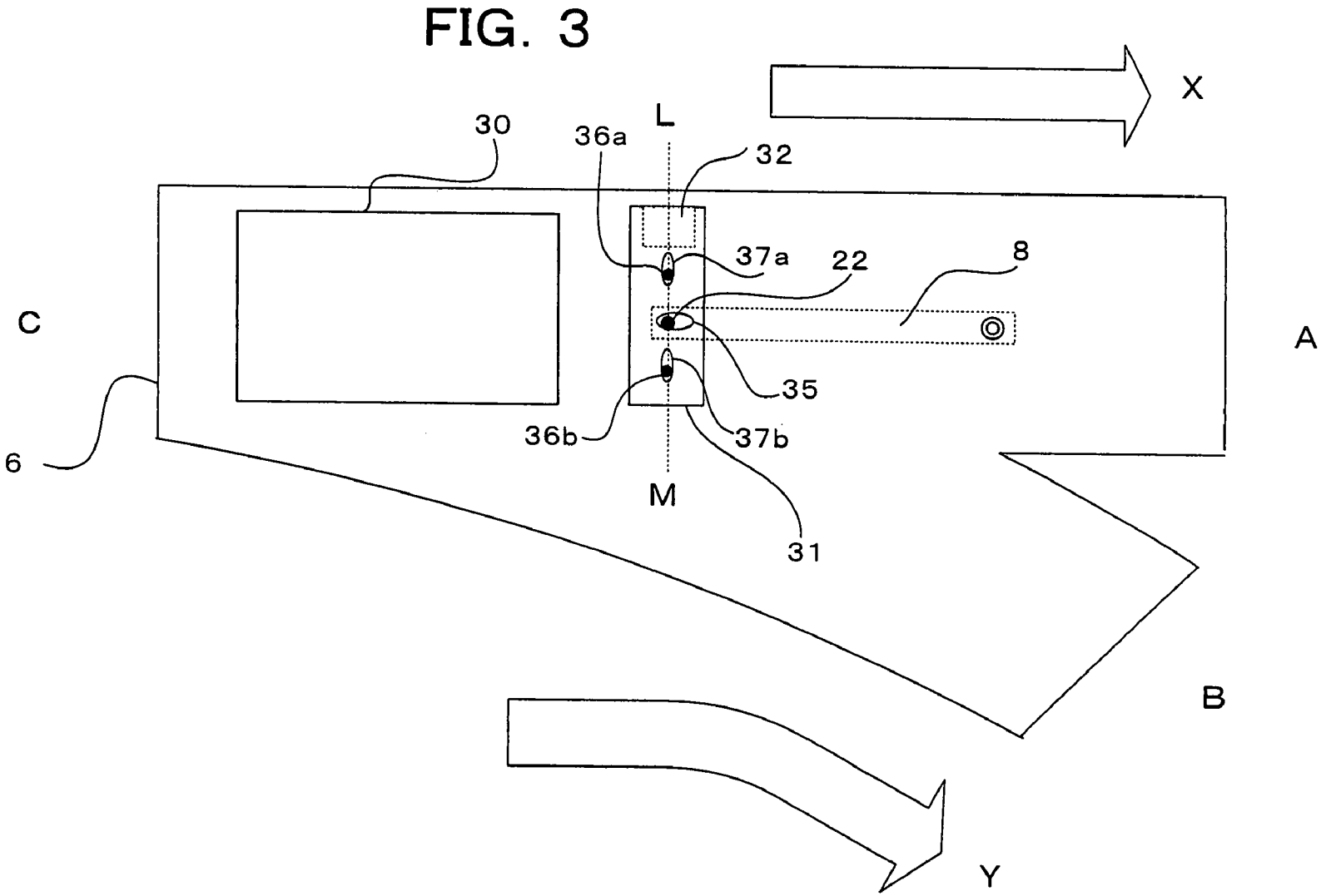
FIG. 3 shows the bottom side of the diverging rails.
Figure 4:
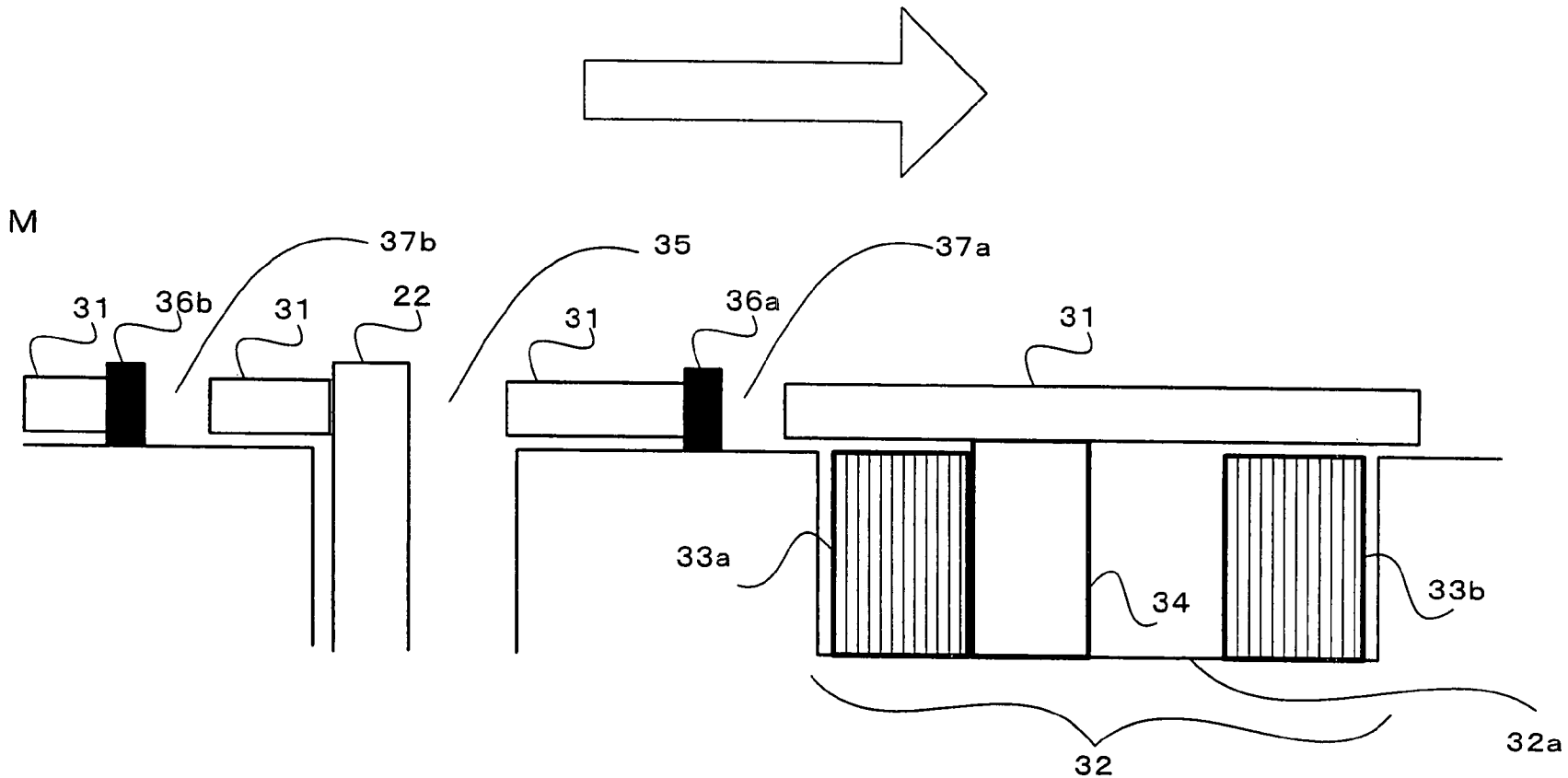
FIG. 4 is an enlarged cross-sectional view of the diverging rails, taken along the line L-M of FIG. 3, with the bottom side of the diverging rails facing upward.

Referring now to FIGS. 3 and 4, the configuration for moving the movable portion 21 between the first position P1 and the second position P2 is described. FIG. 3 shows the bottom side of the diverging rails 6. FIG. 4 is a cross-sectional view of the diverging rails 6, taken along the line L-M of FIG. 3. In FIG. 4, the upper side of the diverging rails 6 faces downward. The line L-M is perpendicular to the path X. Hereinafter, the direction perpendicular to the path X will be referred to as the L-M direction(s).

As shown in FIG. 3, a base plate 30 into which an IC is incorporated, a movable plate 31, and a coil placement unit 32 are disposed on the bottom surface of the diverging rails 6. As shown in FIG. 4, the coil placement unit 32 is provided as a concave portion on the bottom side of the diverging rails 6. In the coil placement unit 32, a coil 33*a* as a first coil and a coil 33*b* as a second coil are placed in parallel in the L-M direction, and are arranged at a distance from each other. Hereinafter, the coil 33*a* and the coil 33*b* will be referred to as the coils 33, unless there is a need to specifically distinguish between the two coils. With the bottom surface 32*a* of the coil placement unit 32 facing down, the movable plate 31 is provided to cover the coil placement unit 32. The movable plate 31 has a protrusive sensor 34 that is located at the concave portion formed between the coil 33*a* and the coil 33*b*. The sensor 34 has a ferromagnetic body that characteristically sticks to a magnet. When an exciting current is applied to one of the coils 33, the sensor 34 is attracted to the coil 33 that has generated an induction field and become an electromagnet, and the movable plate 31 is also moved in the same direction. As the sensor 34 moves between the coil 33*a* and the coil 33*b* in the L-M directions, the movable plate 31 moves in the L-M directions.

The movable plate 31 has a hole 35 in which the protrusion 22 of the point 8 can run. As the movable plate 31 moves in the L-M directions, the protrusion 22 moves with the hole 35, and the movable portion 21 moves accordingly.

FIG. 4 shows the situation in which an exciting current is applied to the coil 33*a* to become an electromagnet, and the sensor 34 is attracted to the coil 33*a*. In this situation, the protrusion 22 is located at the first position P1. When an exciting current is applied to the coil 33*b*, the coil 33*b* becomes an electromagnet, and the sensor 34 is attracted to the coil 33*b*. As the sensor 34 moves in the L direction, the movable plate 31 also moves in the L direction, and the protrusion 22 moves with the hole 35. When the sensor 34 sticks to the coil 33*b*, the protrusion 22 is located at the second position P2. The sensor 34 moves between the coil 33*a* and the coil 33*b*, the position of the point 8 is switched between the first position P1 and the second position P2.

Although the movable plate 31 moves in the L-M directions, the protrusion 22 moves along the arc of the circular that has a radius equivalent to the length between the shaft 20 and the protrusion 22, with the shaft 20 being the center. When the movable plate 31 moves in the L direction, the protrusion 22 does not move in a direction parallel to the L direction, but slightly inclines toward the shaft 20. Therefore, the hole 35 should be designed to have such a size as to allow the protrusion 22 to move with the movable plate 31. The hole 35 of this embodiment is formed as a groove-like hole extending in parallel with the path X. Further, guide protrusions 36*a* and 36*b* for guiding the movable plate 31 in the L-M directions are provided on the bottom side of the diverging rails 6, and guide holes 37*a* and 37*b* in which the guide protrusions 36*a* and 36*b* run respectively are formed in the movable plate 31. The guide holes 37*a* and 37*b* of this embodiment are grooves that extend in parallel with the L-M directions.

Figure 5:
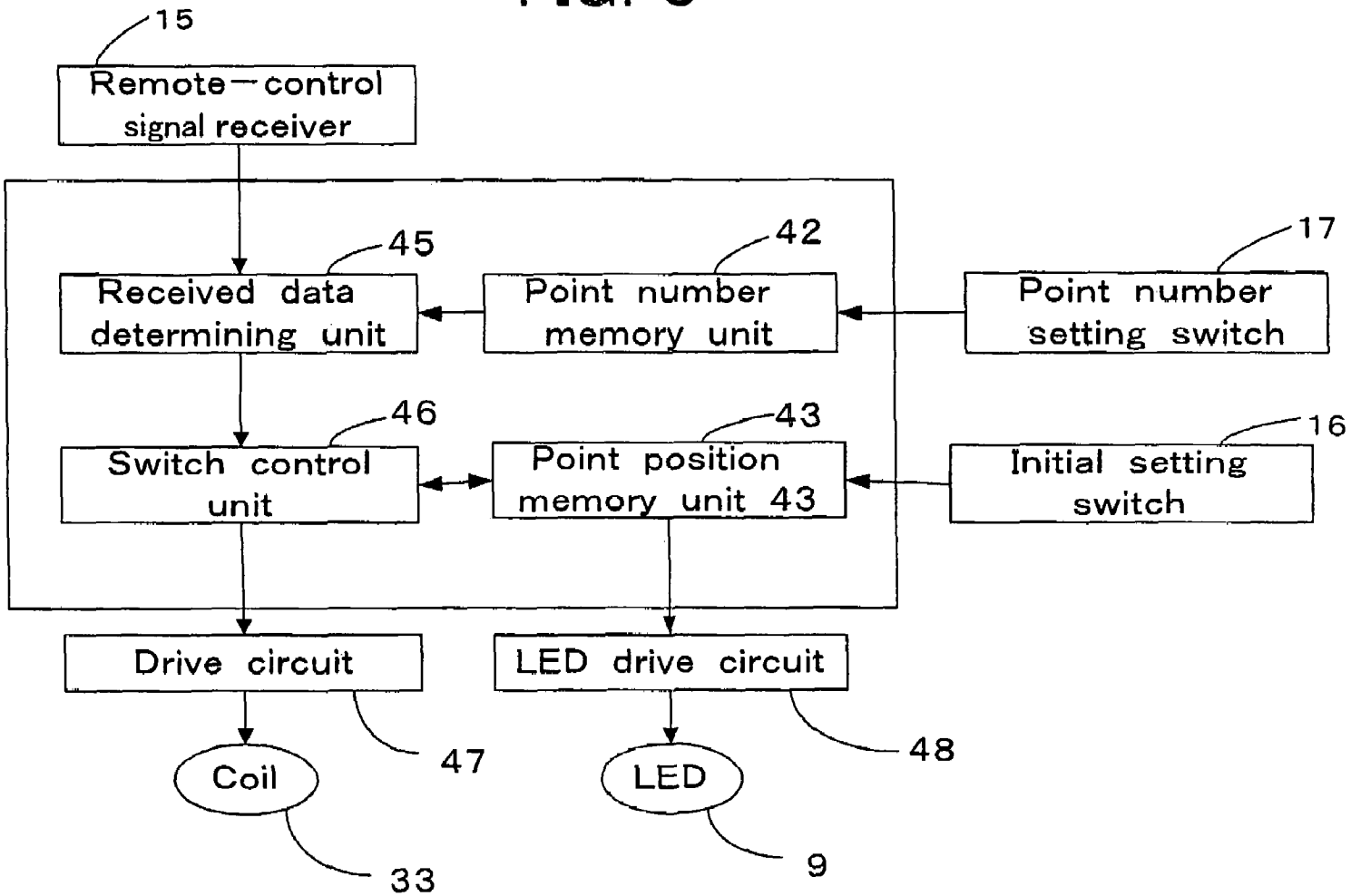
FIG. 5 is a functional block diagram of the point switching device.

FIG. 5 is a functional block diagram of the point switching device 4. The point switching device 4 includes a control unit 40 as an excitation control unit that controls the switching of the point 8 according to a user instruction, as well as the above described remote-control signal receiver 15, the initial setting switch 16, and the point number setting switch 17. The control unit 40 is formed as a computer that includes a CPU and various peripheral circuits such as a RAM and a ROM that are necessary for the operation of the CPU. In the following, the function of each component of the point switching device 4 is described.

When a user sets a point number with the point number setting switch 17, a point number memory unit 42 stores the point number as its own point number. The initial setting switch 16 is a switch for a user to set the initial position of the point 8 to the first position P1 or the second position P2. As the initial position is set by a user, the position is stored in a point position memory unit 43. The point position memory unit 43 stores the current position of the point 8, as well as the initial position.

When receiving the control signal from the controller 2, the remote-control signal receiver 15 sends the control signal to a received data determining unit 45. The received data determining unit 45 determines whether the control signal indicates a point switching instruction that is directed to itself. Whether or not the control signal is determined to be the data to instruct itself to perform point switching depends on whether or not the control signal contains a code for a point switching instruction. Whether or not the control signal is determined to be directed to itself depends on whether or not the control signal contains the point number that is set with the point number setting switch 17. When the received data determining unit 45 determines that the control signal is a signal for instructing itself to perform point switching, a signal for a point switching instruction is sent to a switch control unit 46. Upon receipt of the point switching instructing signal, the switch control unit 46 refers to the current position of the point 8 stored in the point position memory unit 43, and determines the position P1, P2 to which the movable portion 21 should be moved. The switch control unit 46 then transmits an instruction signal to a drive circuit 47 to intermittently supply an exciting current to the coil 33 corresponding to the determined position. According to the instruction transmitted from the switch control unit 46, the drive circuit 47 intermittently supplies an exciting current to the designated coil 33.

An LED drive circuit 48 refers to the position P1 or P2 of the point 8 stored in the point position memory unit 43, and determines a travelable path. The LED drive circuit 48 then turns on the LED lamp of the LED display unit 9 corresponding to the determined path, and turns off the LED lamp of the LED display unit 9 irrelevant to the determined path.

Figure 6:
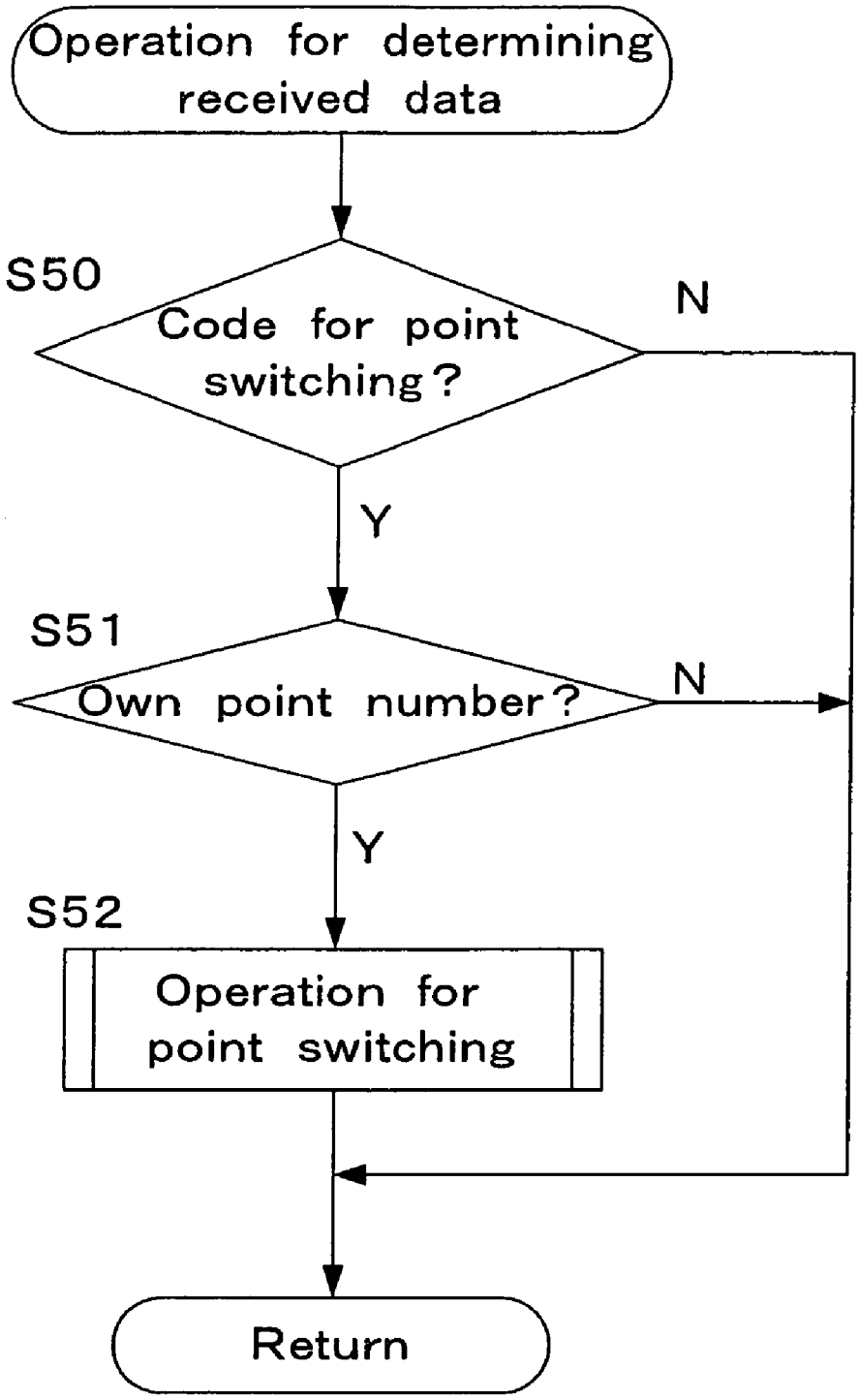
FIG. 6 is a flowchart of the received data processing to be performed by the control unit of the point switching device.
Figure 7:
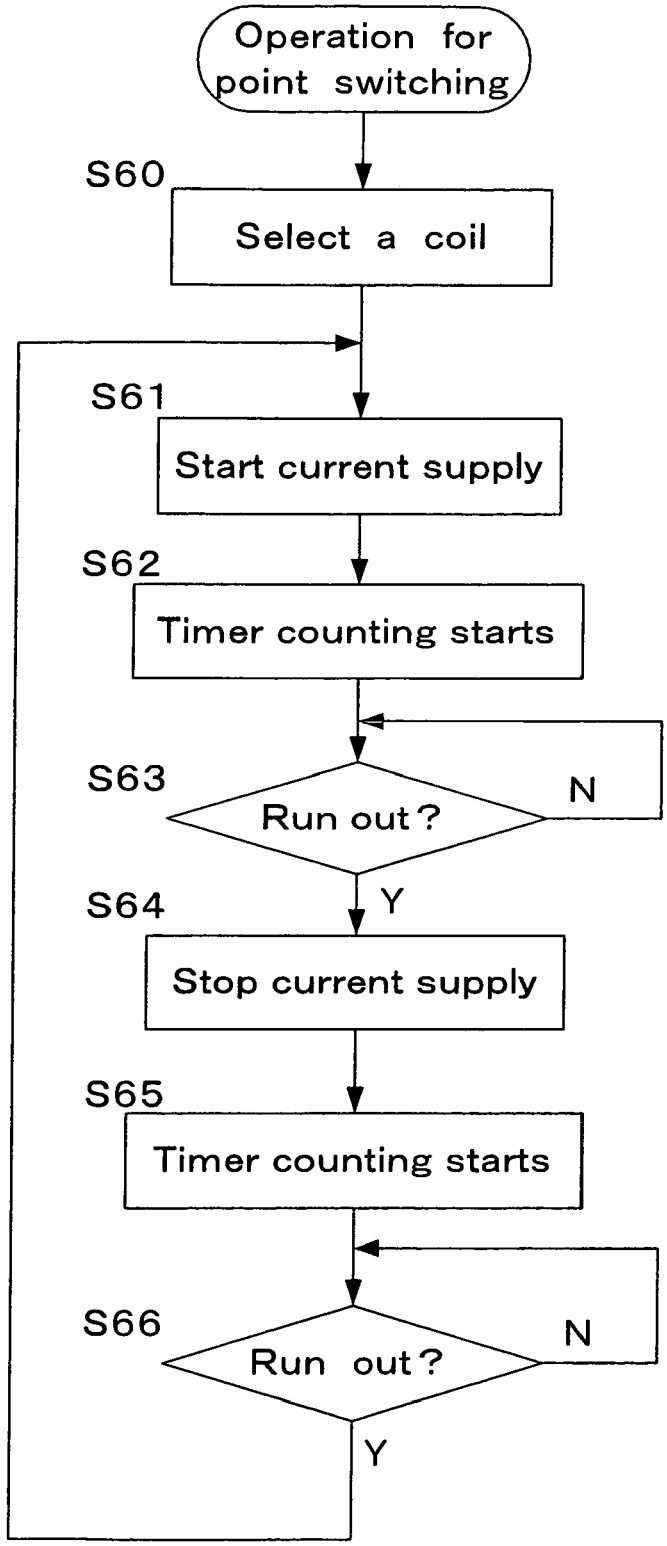
FIG. 7 is a flowchart of the point switching operation to be performed by the control unit of the point switching device.

Referring now to FIGS. 6 and 7, the operation flow for the point switching to be performed by the control unit 40 is described.

First, whether received data contains a code for point switching is determined (step S50). If the received data contains such a code, the received data is determined to be point switching data, and continuously whether the received data contains the point number of itself is determined (step S51). If the received data contains the point number, the received data is determined to instruct itself to perform point switching, and the operation moves on to the point switching operation (step S52). If the received data does not contain the point number of the device, it is put into a standby state to wait for a remote-control signal.

In the point switching operation, the position to which the point 8 is to be switched is first specified in step S60, and the coil 33 corresponding to the specified position is selected. An instruction to start an exciting current supply to the selected coil 33 is then issued (step S61). When the exciting current supply starts, timer counting also starts (step S62). The timer is counted until the preset timer runs out (step S63). When the preset timer is determined to have run out, an instruction to interrupt the exciting current supply is issued (step S64). Then, the timer counting starts (step S65), and is continued until the preset timer runs out (step S66). When the preset timer is determined to have run out, the operation returns to step S61 to start supplying the exciting current again. The procedures up to step S66 are then repeated.

As a result of the above procedures, an exciting current is intermittently supplied to the coil 33 selected in step S60. In the above described operation, the control unit 40 performs in a time-sharing multitasking mode. Although the procedures of steps S61 to S66 for intermittently supplying an exciting current are repeated, when a next point switching signal for itself is received, the point switching operation according to the received instruction is started as an interrupt operation. Also, the exciting current is intermittently supplied through the timer counting operation by the control unit 40 in the above described operation. However, the intermittent timing may be stored beforehand in the drive circuit 47. In such a case, the control unit 40 selects the coil 33 to which the exciting current is to be supplied, and simply issues an instruction to supply the exciting current to the selected coil 33, so that the drive circuit 47 supplies the exciting current to the selected coil 33 in the predetermined timing.

Figure 8:
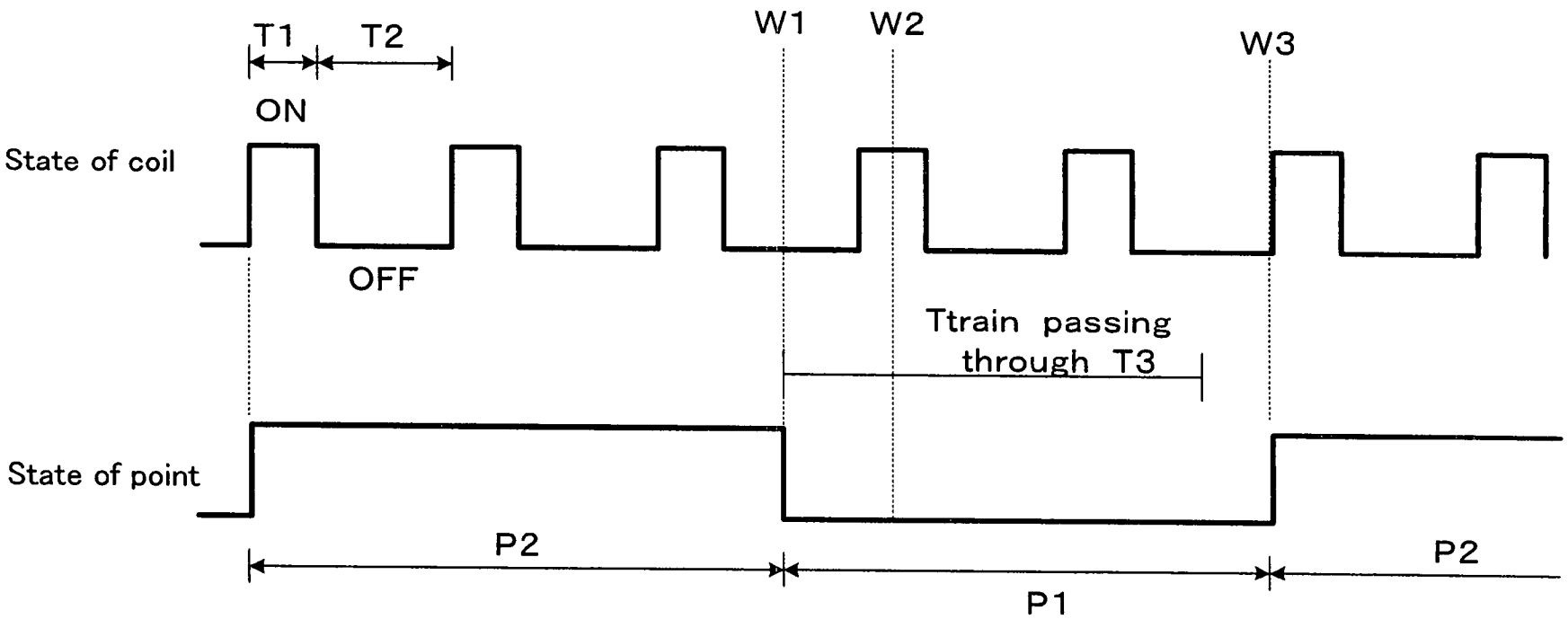
FIG. 8 shows the relationship between the state of the coils and the sate of the point.
Figure 9:
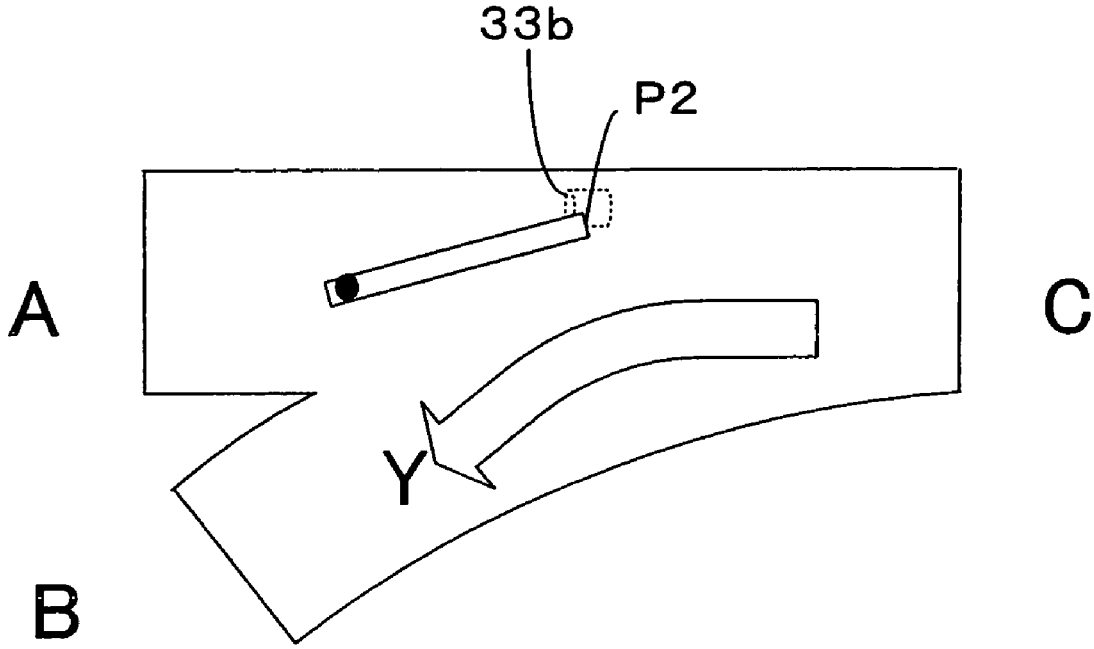
FIG. 9 is a schematic view showing a situation in which the point moves in such a manner as to make one path travelable through a point switching operation by a user.
Figure 10A:
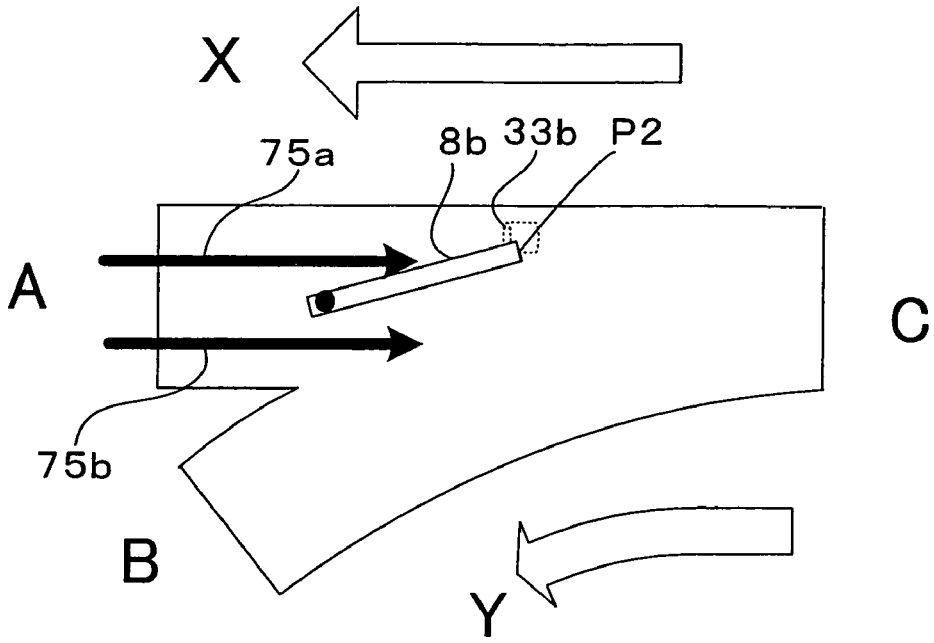
FIG. 10A is a schematic view showing a situation in which the train model runs into the point from the opposite direction of a path that is different from the travelable path.
Figure 10B:
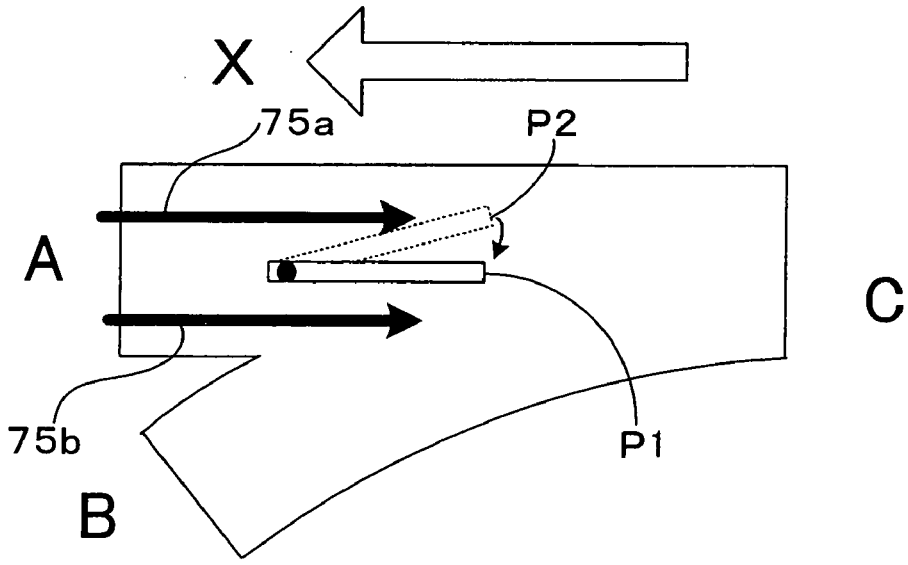
FIG. 10B is a schematic view showing a situation in which the train model can pass through the diverging point.

Referring now to FIGS. 8, 9, 10A, and 10B, the state of the point 8 affected by intermittently supplying the exciting current to the coil 33 is described. FIG. 8 shows the relationship between the state of the coil 33 to which the exciting current is supplied and the position of the point 8. FIG. 9 is a schematic view showing the position of the point 8 that is switched through a point switching operation by a user. FIGS. 10A and 10B are schematic views showing movement of the point 8.

A case where the point 8 is located in the second position P2 as shown in FIG. 9 is now described. Here, an exciting current is intermittently supplied to the coil 33*b* corresponding to the second position P2, as described above. Accordingly, the coil 33*b* repeatedly switches between an electromagnetic state T1 and a non-electromagnetic state T2, as shown in FIG. 8.

A case where the train model 1 runs in the reverse direction of the path X in the above state is now described. A trail 75*a* shown in FIG. 10A is the trail that is drawn by the left-side front wheel 72 in the traveling direction of the train model 1, and a trail 75*b* is the trail that is drawn by the right-side front wheel 72 in the traveling direction of the train model 1. As shown in FIG. 10A, the left-side front wheel 72 in the traveling direction runs into the rim 8*b* on P2-side of the point 8. As shown in FIG. 8, if the timing W1 falls in the state T2 in which the coil 33*b* is not an electromagnet, the position of the point 8 is not maintained. Accordingly, the point 8 is pushed in the traveling direction of the train model 1, and moved to the first position P1. Thus, the train model 1 can travel in the reverse direction of the path X. FIG. 10B shows such a situation. In this situation, an exciting current is intermittently supplied to the coil 33*b* even during a time T3 in which the train model 1 is passing through the point 8 in the reverse direction of the path X. Accordingly, the timing W2 in which the coil 33*b* again becomes an electromagnet falls in the time T3. In such a case, however, the point 8 is interrupted by the left-side wheels 72 and 73 in the traveling direction of the train model 1, so that the point 8 cannot return to the second position P2. After the train model 1 passes through the point 8, the point 8 returns to the second position P2 in the timing W3 in which the coil 33*b* again becomes an electromagnet.

When the point 8 is switched so as to travel along the path Y, it is not necessary for a user to switch the point 8 so as to allow the train model 1 to pass through the point 8 in the reverse direction of the path X. The same applied to the case where the point 8 is located in the first position P1, that is, the path X is travelable according to a point switching instruction from a user.

If the coil 33 is in the electromagnetic state T1 when the front wheels 72 of the train model 1 traveling in the reverse direction of the path X run into the point 8, the train model 1 is stopped until the coil 33 is put into the non-electromagnetic state T2, and the point 8 is then moved so as to let the train model 1 pass. To shorten the stopping time, it is preferable to make the duration of the electromagnetic state T1 very much shorter than the duration of the non-electromagnetic state T2. Alternatively, the force for maintaining the position of the point 8, namely, the suction force of the electromagnetic coil 33, may be made smaller than the force of the train model 1 pushing the point 8.

The present invention is not limited to the above embodiment, and various modifications may be made to it. For example, although the suction force of a magnetic body is utilized in the above embodiment, it is possible to utilize repulsive force.

Also, a movable body 1 is not necessarily the train model 1, but any other type of movable body that can travel on tracks, such as a vehicle model, may be employed. Such a movable body does not need to have the wheels 72 and 73, and may only have a contact portion that is to be in contact with the track pieces 10 and the point 8. Further, the driving method for the movable body 1 is not limited to a motor, as long as it can be controlled by the controller 2.

Although the battery placement unit 19 is provided in the point switching device 4 in the above embodiment, it is not necessary to employ the battery placement unit 19 if a current is supplied to the tracks 3. Also, the exciting current to be supplied to the selected coil 33 is not necessarily a direct current, but may be an alternating current.

It is also possible to set the point number and the initial position of the point 8 according to an instruction from the controller 8.

As described so far, the present invention can provide a point switching device that does not require a point switching operation to allow a movable body traveling in the reverse direction of a non-selected path of the diverging paths to pass through the point.

The invention claimed is:

1. A point switching device that is provided at a diverging point on tracks on which a movable body travels, comprising:

a point adapted to move between a first position and a second position by rotating about a support point on one end thereof;

a first coil for generating an induction field to drive the point to the first position;

a second coil for generating an induction field to drive the point to the second position; and an excitation control unit operable for selecting one of the first coil or the second coil and for supplying an intermittent exciting current to the selected coil for driving the point to the first position or the second position, respectively, wherein:

the excitation control unit is configured such that in response to a control signal, the excitation control unit continues to supply the intermittent exciting current to the selected coil until the other one of the first coil and the second coil is selected.

2. The point switching device according to claim 1, further comprising:

an electricity supply unit, having a battery as a source of electricity, for supplying electricity for operating the excitation control unit.

3. The point switching device according to claim 1, further comprising:

a point position display unit for displaying on the tracks whether the point is located in the first position or the second position.

4. The point switching device according to claim 1, wherein the excitation control unit is configured to supply the intermittent exciting current by repeatedly executing the steps of:

supplying an exciting current for a first predetermined period of time, and removing the exciting current for a second predetermined period of time.

5. The point switching device according to claim 4, wherein the second predetermined period of time is greater than the first predetermined period of time.

* * * * *

UNITED STATES PATENT AND TRADEMARK OFFICE

CERTIFICATE OF CORRECTION

PATENT NO. : 7,367,533 B2
APPLICATION NO. : 10/542866
DATED : May 6, 2008
INVENTOR(S) : Takashi Yamaguchi et al.

It is certified that error appears in the above-identified patent and that said Letters Patent is hereby corrected as shown below:

In the Front Cover Item (73) Assignee:

Please insert --Konami Digital Entertainment Co., Ltd.--

Signed and Sealed this

Eighteenth Day of November, 2008

JON W. DUDAS
*Director of the United States Patent and Trademark Office*